US005351586A

United States Patent [19]

Habermehl et al.

[11] Patent Number: 5,351,586

[45] Date of Patent: Oct. 4, 1994

[54] SCREWDRIVER REPLACEMENT BIT ASSEMBLY

[75] Inventors: G. Lyle Habermehl, 7528 Hickory Hill Ct., Whites Creek, Tenn. 37189; Paul T. Scherer, Lexington, Ky.

[73] Assignee: G. Lyle Habermehl, Whites Creek, Tenn.

[21] Appl. No.: 44,956

[22] Filed: Apr. 8, 1993

[51] Int. Cl.[5] ..... B25B 23/16

[52] U.S. Cl. ..... 81/438; 81/451; 81/57.37

[58] Field of Search ..... 81/438, 451, 57.37, 81/434, 435; 279/155

[56] References Cited

U.S. PATENT DOCUMENTS

| | | | |
|---|---|---|---|
| 233,486 | 10/1880 | Donaldson . | |
| 1,080,560 | 12/1913 | Johanson . | |
| 1,465,612 | 8/1923 | Morse . | |
| 1,502,528 | 7/1924 | Reulbach . | |
| 2,667,194 | 1/1954 | Fischer et al. | 81/438 |
| 3,347,293 | 10/1967 | Clark | 81/438 |
| 3,358,117 | 12/1967 | White | 279/155 |
| 3,900,058 | 8/1975 | McArdle . | |
| 3,935,762 | 2/1976 | Tudisco | 81/438 |
| 4,096,896 | 6/1978 | Engel . | |
| 4,146,071 | 3/1979 | Mueller et al. . | |
| 4,526,069 | 7/1985 | Cecil . | |
| 4,535,658 | 8/1985 | Molinari | 81/438 |
| 4,586,406 | 5/1986 | Howard . | |
| 5,012,708 | 5/1991 | Martindell | 81/451 |
| 5,186,085 | 2/1993 | Monacelli | 81/434 |

*Primary Examiner*—Robert C. Watson
*Attorney, Agent, or Firm*—Dorsey & Whitney

[57] ABSTRACT

An improved screwdriver in which a replaceable bit is removable secured to a mandrel by the bit being axially slidable in an axial socket in the end of the mandrel. A resilient split-ring which serves to retain the bit in the socket is carried by and replaceable with the bit. With each new bit a new split-ring is also provided.

26 Claims, 5 Drawing Sheets

FIG. 1.
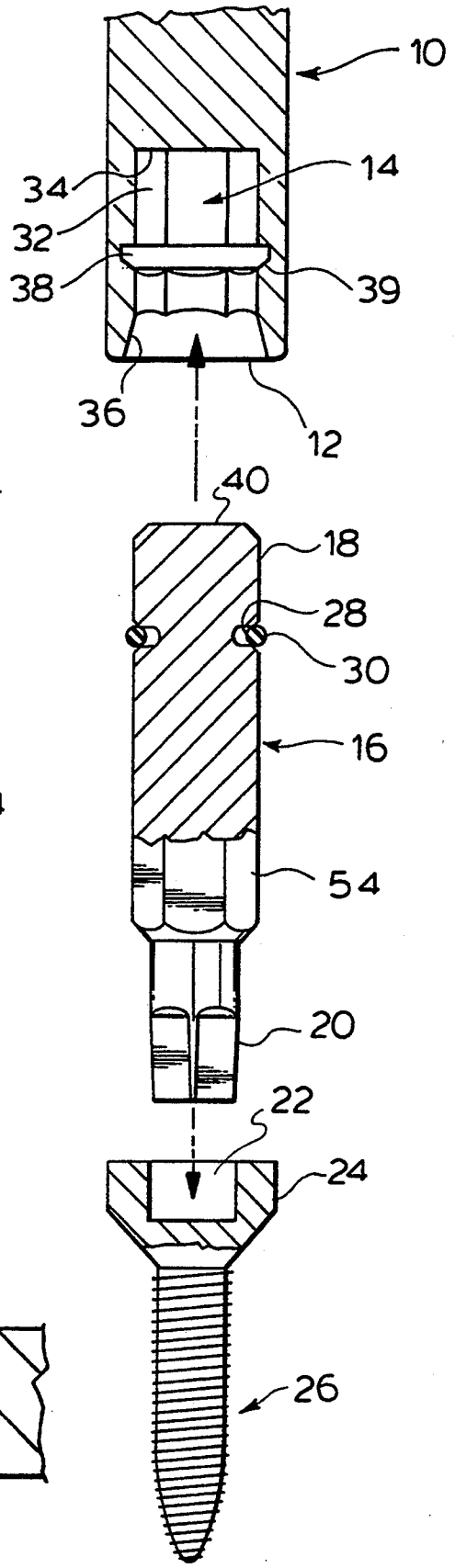
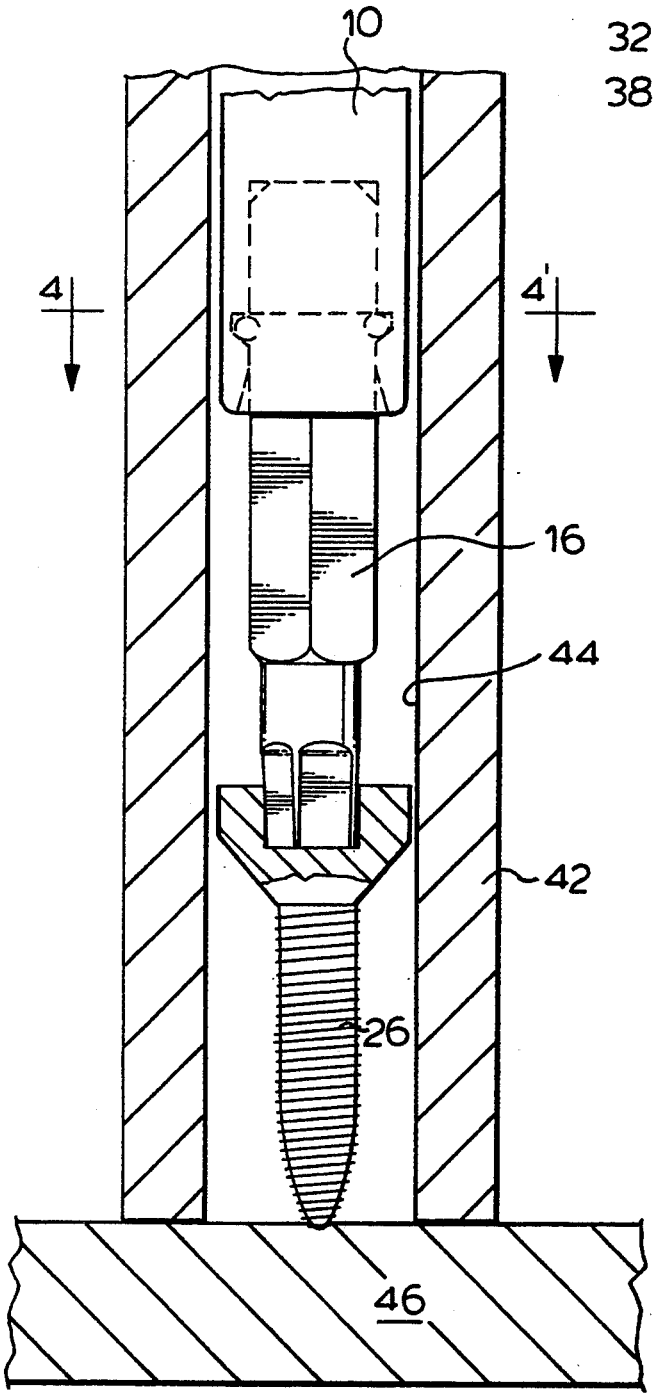
FIG. 2.

SCREWDRIVER REPLACEMENT BIT ASSEMBLY

SCOPE OF THE INVENTION

This invention relates to a screwdriver having a replaceable bit for driving screws and, more particularly, to screwdrivers wherein the bit is slidably received within a socket formed in the screwdriver mandrel.

BACKGROUND OF THE INVENTION

Screwdrivers having removable bits for engaging and driving screws into a work-piece are known. These screwdrivers typically have an elongate mandrel to which at one end a bit is removably coupled.

In many screwdrivers, the bit is coupled to the mandrel by threads. For example, in a power screwdriver disclosed in U.S. Pat. No. 4,146,071 to Mueller et al, issued Mar. 27, 1970, the bit has a reduced diameter male, externally threaded portion to be received within an internally threaded female socket in the mandrel. The present inventor has appreciated that a threaded coupling has the disadvantage that the mandrel and bits are both expensive and as well render it difficult and time consuming to change the bit.

The power screwdriver of U.S. Pat. No. 4,146,071 utilizes a system in which the head of a screw is located and retained in coaxial alignment with the mandrel and bit by the head of the screw engaging a part-cylindrical guideway member having a diameter approximately equal to the diameter of the head of the screw. In such a configuration, it is necessary that the mandrel and bit be of a sufficiently small diameter that the mandrel and bit may reciprocate axially through the part-cylindrical guideway member. The constraints of the mandrel and bit being of a diameter not greater than the diameter of the screw head, renders replacement of the threaded coupling of the bit to the mandrel with another system difficult.

Other bit to mandrel coupling systems are known in which the mandrel carries a resilient split-ring in a deep groove in a socket in the mandrel. When the bit is inserted into the socket, the split-ring retains the bit in the socket by the split-ring being partially received in a groove about the bit. Such known systems suffer the disadvantage that with repeated use, the split-rings come to fail as by losing their resiliency. Failure of the ring whether resulting in jamming of the bit in the socket or fracture of the split-ring results in expensive replacement of the mandrel since the split-ring is carried by the mandrel.

Insofar as the external diameter of a mandrel must be limited to the diameter of the head of the screw, serious disadvantages arise in the use of known split-ring systems. Firstly, with reducing diameter of the mandrel, the split-ring must be reduced in size. Reducing the size of the split-ring greatly disadvantageously effects the reliability of the split-ring, its consistency in manufacture and increased likelihood of a failure of the coupling system. In systems which the split-ring is carried by the socket, the present inventor has appreciated the disadvantage that the sidewall of the mandrel about the socket must have sufficient radial depth to receive the split-ring totally therein. This requires increased thickness of the mandrel about the socket. Machining the socket to have a groove with a radial depth sufficient to totally receive the split-ring becomes increasingly difficult with sockets of smaller diameter. Using smaller diameter split-rings has the disadvantage that in ensuring a bit is secured against removal, the split-rings must be selected such that forces required to axially withdraw the bits become great due to the variance of the small split-rings when manufactured. Frequently, small diameter split-rings only permit withdrawal of a bit with extremely considerable forces as requiring the use of a vice or plyers or are too easily removed.

SUMMARY OF THE INVENTION

To overcome some of these disadvantages, the present invention provides, in a screwdriver in which the mandrel and bit are sized to not be larger than the head of a screw to be driven, an improved bit to mandrel coupling assembly in which the bit is axially slidably received in a socket in the mandrel with the bit removably coupled therein by a resilient coupling device such as a split-ring carried by and removable with the bit.

To overcome other disadvantages of the prior art, the present invention provides in a screwdriver with a bit axially slidably received in a socket in the mandrel, a separate lever tool to simultaneously engage both the bit and socket and fulcrum from the socket to apply considerably axially directed forces to the bit to release the bit from the socket.

An object of the invention is to provide an improved removable bit for use with a screwdriver, particularly power screwdrivers.

Another object of the invention is to provide a system for removably coupling a screw engaging bit into a screwdriver mandrel which permits the diameter of the mandrel to be reduced as far as possible.

Another object of the invention is to provide a system for removably coupling a bit into a screwdriver mandrel by which a resilient coupling is replaceable with the bit.

Accordingly, in one aspect the present invention provides a driver to drive a screw having a selected maximum diameter, the driver comprising:

rotatable screwdriver means comprising:

elongate means having in one end thereof axially extending socket means with replaceable, screw engaging bit means axially slidably removably received in the socket means for rotation with the socket means;

guideway means to guide a screw coaxially therein, the guideway means having a diameter equal to or marginally greater than the maximum diameter of the screw to assist in coaxially locating and guiding the screw therein, the mandrel means and bit means reciprocally axially movable in the guideway means for engaging and driving a screw through the guideway means into a workpiece;

resiliently deformable means removably retaining the bit means in the socket means;

the resiliently deformable means carried by and removable with the bit means.

In another aspect, the present invention provides a screwdriver having:

elongate mandrel means having in one end thereof axially extending socket means;

removable, screw engaging bit means axially slidably received in the socket means for rotation with the socket means;

the bit means retained in the socket means against removal under axially directed forces less than a required force;

axially directed bit engagement surfaces on the bit means;

axially directed socket engagement surfaces on the mandrel means juxtapositioned relatively to the bit engagement means when the bit means is received in the socket means to be directly axially opposed to the bit engagement surfaces;

separate bit removing lever means having two ends with a first end adapted for simultaneous engagement of both the bit engagement surface and socket engagement surfaces whereby manual pivoting of the other, second end of the lever means with the socket engagement surfaces as a fulcrum applies axially directed forces to the bit engagement surfaces to remove the bit means.

BRIEF DESCRIPTION OF THE DRAWINGS

Further aspects and advantages of the present invention will appear from the following description taken together with the accompanying drawings, in which:

FIG. 1 shows an exploded partial cross-sectional side view of a first embodiment of the present invention including a mandrel and a replaceable bit aligned with a screw to be driven;

FIG. 2 shows a partial cross-sectional side view of the mandrel, bit and screw of FIG. 1, coaxially received within a cylindrical guideway;

DETAILED DESCRIPTION OF THE PREFERRED EMBODIMENTS

Figure 3:
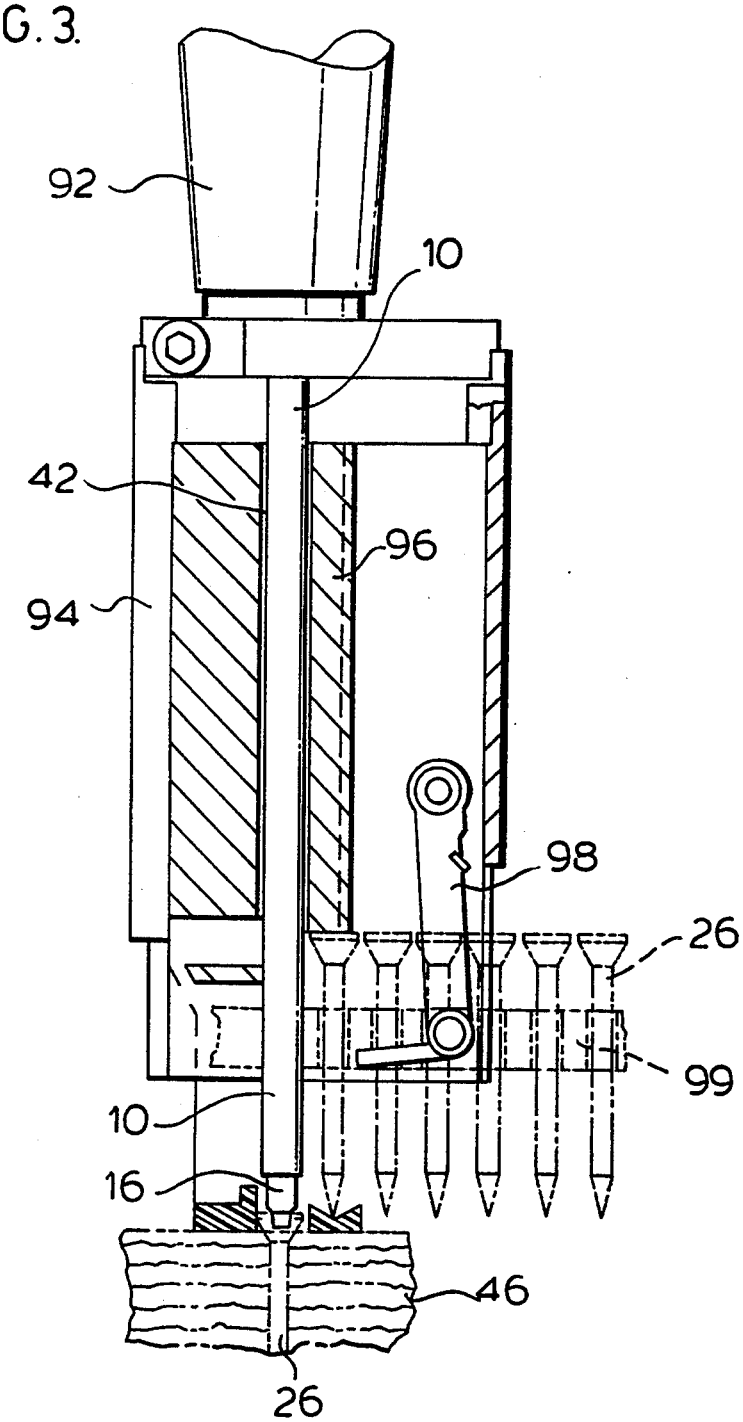
FIG. 3 is a schematic, partial cross-sectional side view of a power screwdriver of U.S. Pat. No. 4,146,071 modified to accommodate a mandrel and replaceable bit in accordance with the first embodiment of the present invention.

Reference is made first to FIG. 1 which shows as a first preferred embodiment of the invention, an elongate mandrel 10 having at a lowermost end 12 an axially inwardly extending socket 14 adapted to axially slidably receive a replaceable screw engaging bit 16.

The bit 16 has a hexagonal shaped body 18 at one end and a screw driving tip 20 at the other end. Tip 20 is adapted for engaging a complimentary shaped slot 22 formed in the head 24 of a screw 26. A circumferential groove 28 is formed in body 18 to extend radially inwardly into the body normal to the axis of the bit 16. A split-ring 30, which is elastically deformable from an unbiased to a biased configuration, is retained within groove 28, and is thereby carried with and secured to bit 16. The split-ring 30 comprises, preferably, a piece of metal having a circular cross-section, and which is formed so that when unbiased, the split-ring 30 has an elastic tendency to return to a generally circular configuration of a set diameter.

The hexagonal shaped body 18 of the bit 16 is adapted to be slidably received in socket 14 formed in mandrel 10. Socket 14 has an innermost hexagonal portion of hexagonal shape in cross-section with six axially parallel sidewalls 32 closed by an end wall 34. A forwardmost mouth portion of the socket has frustoconical sidewalls 36 which taper inwardly from the end 12 into the hexagonal portion and assist in guiding a bit 16 to be inserted into the socket. A circumferential groove 38 is formed in the sidewalls 32 extending radially outwardly about the socket 14 inwardly from end 12.

As is to be appreciated, the hexagonal shaped body 18 of the bit 16 is sized for sliding insertion into the socket 14 via its open end. When fully received within socket 14, the end 40 of the bit 16 opposite tip 20 is in abutment with the end wall 34 of the socket and groove 28 of the bit aligns with the groove 38 of the socket whereby the split-ring 30 locates in part in each of the grooves 28 and 38 to restrict removal of the bit 16. The length of the bit 16 is selected so that when fully inserted into the socket 14, the tip 20 extends outwardly beyond the open axial end of the socket a sufficient distance to permit unhindered engagement of the tip 20 in the screw head 24. The sidewalls 32 of the socket 14 are complimentary to the hexagonal shaped body 18 of the bit 16 such that the bit 16 is rotated upon rotation of the mandrel 10.

FIG. 2 shows the mandrel 10 and a screw 26 coaxially aligned in operative engagement within a guideway 42. The guideway illustrated comprises a hollow cylindrical tube having an inside diameter equal to or marginally greater than the diameter of the screw 26 to be driven. The guideway 42 serves a number of different functions. Preferably, it serves to locate and guide screw 26 coaxially therein by engagement between the circumferentially outermost portions of the head 24 of the screw and radially innermost walls 44 of the guideway. This assist in the mandrel and bit, which preferably rotate and are coaxially slidable in the guideway 42 in amongst other things, engaging the slot 22 in the screw 26 and driving the screw into a workpiece 46.

Guideways similar to that illustrated in FIG. 2 are described, for example, in powers screwdrivers of the type disclosed in U.S. Pat. No. 4,146,671 which is incorporated herein by reference as well as in the applicant's co-pending U.S. patent application Ser. No. 08/018,897, filed Feb. 17, 1993, entitled "Screw Strip Apparatus for Use in Driving Screws Joined Together in a Strip" (which is also incorporated herein by reference).

For certainty, the nature and operation of the split-ring 30 is discussed in detail with reference to FIGS. 1, 2, 4 and 5.

Figure 4:
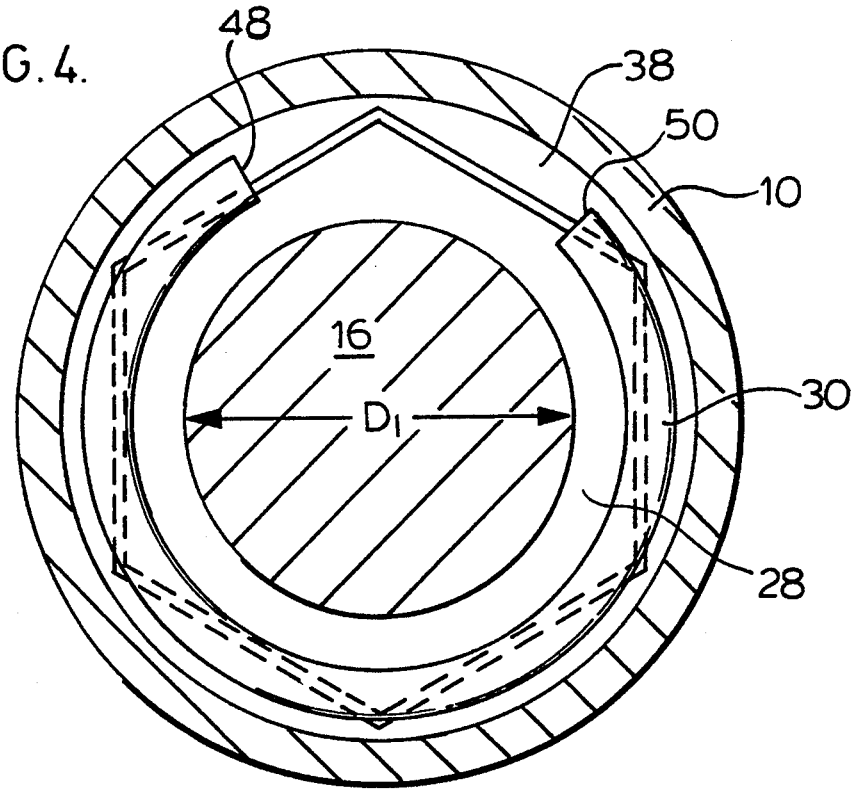
FIG. 4 shows a cross-sectional view of the mandrel and bit of FIG. 2 taken along lines 4—4'.
Figure 5:
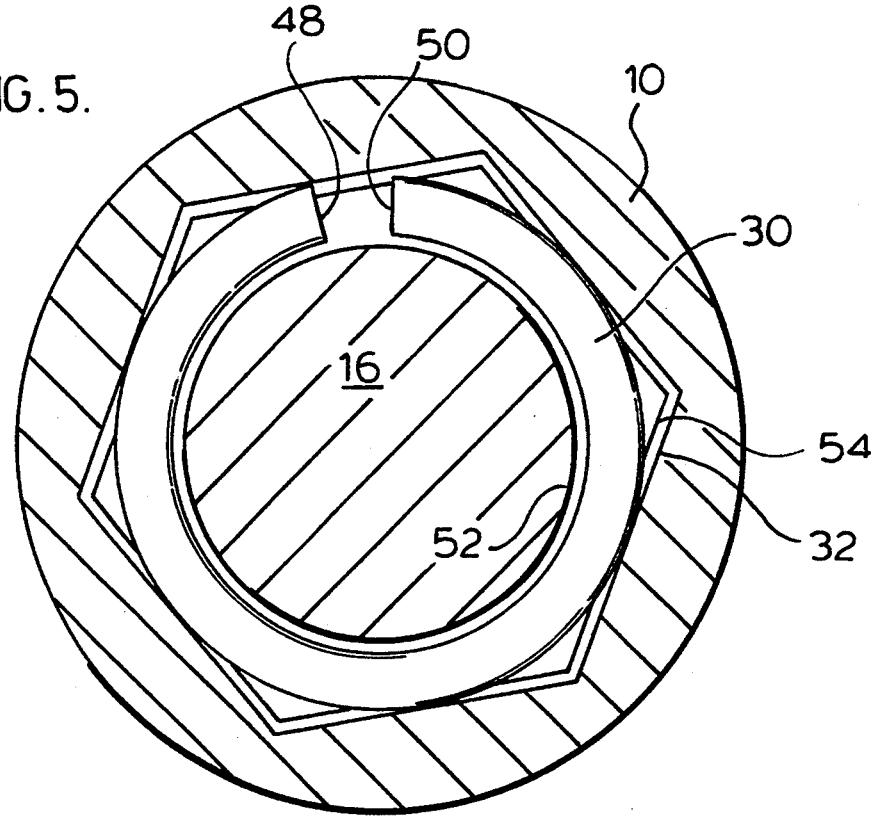
FIG. 5 shows the same cross-sectional view through the bit as in FIG. 4 but with the bit axially moved within the socket sufficient that the groove in the bit does not align with the grove in the mandrel.

Split-ring 30 is secured to bit 16 within the groove 28 against removal by the split-ring extending about the bit a sufficient axial extent. In this regard, the distance between the ends 48 and 50 of the split-ring when unbiased should be less than the innermost diameter D1 of the bit radially inside groove 28. As seen in FIGS. 2 and 4, when unbiased the split-ring 30 is located in part within groove 28 and in part within groove 38. The groove 28 within the bit 16 is sufficiently deep, that is, it has a radial depth sufficient, having regard to the thickness of the metal forming the split-ring 30, when biased radially inwardly as seen in FIG. 5, that the split-ring 30 may be received effectively totally within the groove 28, that is, with the split-ring 30 preferably disposed between the radially innermost surface 52 of the groove 28 and the outer sides 54 of the hexagonal shaped body 18 and at least between surface 52 of groove 28 and walls 32 of the socket 14.

FIGS. 1 and 2 show best the insertion and retention of the bit 16 within the socket 14. With the hexagonal shaped body 18 of the bit 16 and the hexagonally shaped socket 14 axially aligned and in registry, the end 40 of the bit 16 is axially slidably inserted into the open end of the socket 14.

As the split-ring 30 is moved inwardly into the socket 14 by forces applied axially to the bit, firstly, the tapering sidewalls 36 of the mouth portion and subsequently the sidewalls 32 of the hexagonal inner portion contact radial outermost portions of the split-ring 30 compressing the split-ring inwardly into groove 28 to a biased configuration similar to that shown in FIG. 5. The split ring 30 remains compressed within groove 28 until groove 28 is moved into alignment with groove 38 when the split-ring 30 expands to the substantially unbiased configuration of FIG. 4. As seen in FIG. 4, with the bit 16 fully inserted in the socket 14, the split-ring 30 is located partially in groove 28 and partially in groove 38 locking the bit 16 against axial withdrawal. The bit 16 may be removed from the socket 14 by applying an axially directed force sufficient that engagement between forward edge 39 of the groove 38 of the socket and the split-ring 30 causes the split-ring 30 to be forced to a compressed configuration as shown in FIG. 5. The forces required for withdrawal of the bit may typically be required to be considerable so as to prevent the removal of the bit 16 under forces experienced in normal screw driving conditions. The forward edge 39 of groove 38 is preferably disposed at an angle to the central axis to tilt radially inwardly and axially outwardly. Having forward edge 39 at an angle permits the forward edge 39 to cam the split-ring 30 radially outwardly and permits the bit 16 to be withdrawn by applying axially directed forces. In contrast, groove 28 preferably has edges which extend perpendicular to the axis.

As split-ring 30 is carried by the bit 16, and retains the bit 16 in the socket 14 locating only partially within the groove 38, the groove 38 in the socket may have a depth less than the thickness of the split-ring 30. Preferably, the groove 38 may have a radial depth which is less than the thickness of the split-ring 30, and more preferably less than ½ the depth of the split-ring 30. This permits the thickness of the walls of the mandrel about the socket to advantageously be small allowing the mandrel 10 to have as small an exterior diameter as possible.

Having regard to a system as in FIG. 2, where the mandrel is to be axially slidable in a guideway of a diameter approximately equal to the maximum diameter of a screw head, it is important to have as small a diameter for the mandrel as possible. This is particularly so when driving screws having small head diameters of ½ inch or less, and more preferably so with screw head diameters of less than ⅓ inch, less than ¼ inch and less than 3/16 inches. For example, common number 12 wood screws have outer head diameters of about 7/16 inch; common number 8 wood screws having a head diameter of about 5/16 inch and common number 8 wood screws having outer head diameters of about ¼ inch.

It is preferred, from a point of view of cost that the bit 16 comprise a regular polygonal rod with merely one end machined to provide the screw engaging tip 20. Utilizing such a rod avoids the requirement for difficult machining to reduce the size of the polygonal portion to be received within the socket. Utilizing a polygonal rod, however, typically requires a larger diameter socket.

Figure 6:
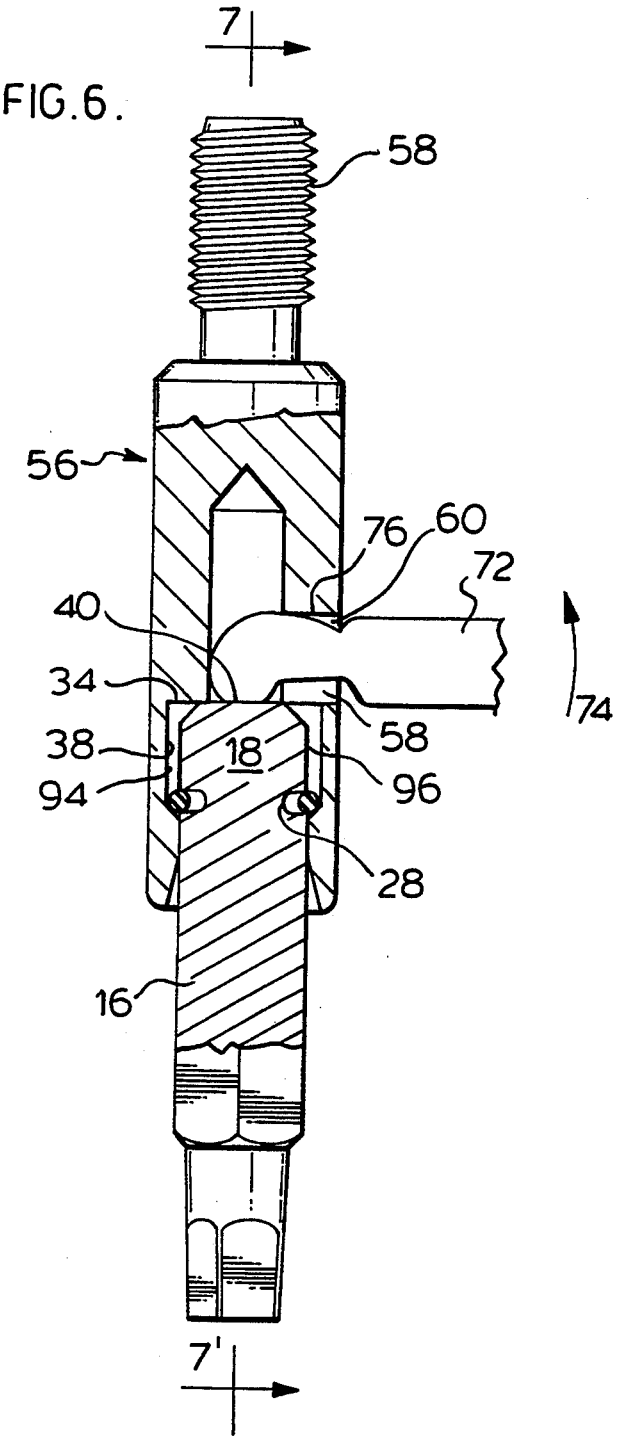
FIG. 6 is a partially cross-sectional side view of a second embodiment of the invention showing a mandrel extension, a replaceable bit and a lever tool to assist in removal of the bit.
Figure 7:
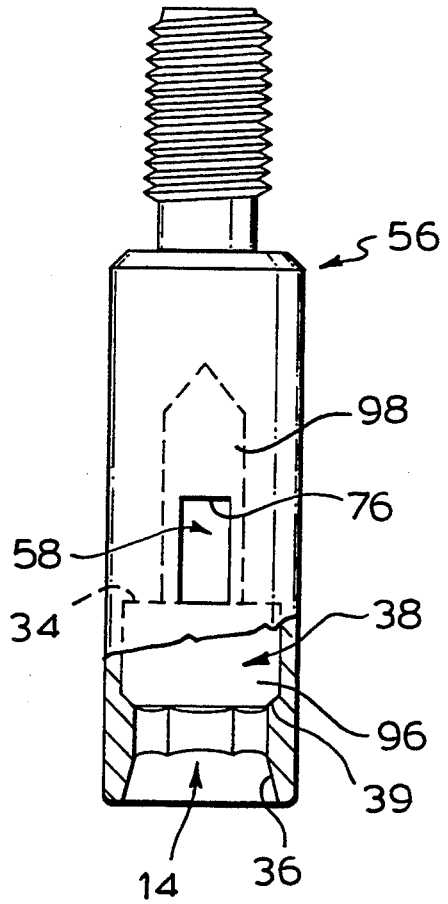
FIG. 7 is a partially cross-sectional side view of the mandrel extension of FIG. 6 along section lines 7—7' in FIG. 6 with the lever tool removed.

Reference is now made to FIGS. 6 and 7 which show a mandrel extension 56 and a bit 16 in accordance with a second embodiment having all of the features of the first embodiment of FIGS. 1 and 2 but including additional features.

Firstly, mandrel extension 56 has a threaded inner end 58 adapted to be received within a threaded socket of a mandrel (not shown) of the same exterior diameter.

Secondly, the groove 38 has been extended axially inwardly from its forward edge 39 to the end wall 34. This groove 38 has cylindrical walls 94 throughout its axial length which walls are spaced radially from the hexagonal body 18 of bit 16 by a space 96 as seen in FIG. 6. Socket 14 of FIGS. 6 and 7 has a hexagonal portion of hexagonal shape in cross-section which is merely intermediate the forwardmost mouth portion with frustoconical sidewalls 36 and the axially enlarged groove 38.

Extending the groove axially inwardly to the end wall 34 serves the purpose of preventing side surfaces of the bit and socket from engaging rearwardly of groove 28 on the bit. It has surprisingly been found that as in the embodiment of FIGS. 1 and 2, side loading on the bit 16 in use resulting in lateral forces between the bit and socket axially inwardly of the groove 28 may result in the bit 16 severing off at the groove 28. Preventing radial (lateral) forces to be transferred between the bit and the socket on both axial sides of the groove 28 is believed to overcome this problem. In the embodiment illustrated, such lateral forces are avoided axially inwardly of the groove 28. Other embodiments to overcome this problem could include, for example, in the context of a socket as in FIGS. 1 and 2, reducing the diameter of the bit axially inwardly of its groove 28.

The forward edge 39 of groove 38 acts as an axially inwardly directed retention shoulder to be engaged by the split-ring 30 when the split-ring 30 is axially inward of edge 39 and thus resist removal of bit 16 from the socket.

Thirdly, the mandrel extension 56 is provided with a slot 58 which extends radially inwardly into the mandrel extension from an opening 60 on one side of the mandrel extension. The slot 58 is immediately rearward of the socket 14 and open to the socket 14 as best seen in FIG. 6.

An elongate lever tool 72 is provided with one end adapted to be inserted into the slot 58 as shown in FIG. 6. By manual levering the remote end of the tool 72 in the direction indicated by arrow 74, the tool engages and applies axially directed forces to the surface of the end 40 of the bit with the axially innermost surfaces of a wall 76 of the slot 58 to be engaged by the tool and acting as a fulcrum. With such a lever tool 72, very great axially directed forces can easily, manually be applied to the bit 16 for its removal. This is particularly advantageous with mandrels having small diameters, preferably less than ½ inch, as it permits use of resilient retaining devices such as the split-ring 30 to include those which only permit removal of the bit under very strong axial forces.

To provide the slot 58, an axially centered circumferential bore 98 extends axially inwardly from the end wall 34. Bore 98 is a diameter which is less than that of the end 40 of the bit such that the end 40 continues to engage the end wall 34 to limit inward movement of the bit into the socket. Slot 58 extends radially inwardly from the outer side of the mandrel extension 56 into the bore 98 as shown.

Figure 8:
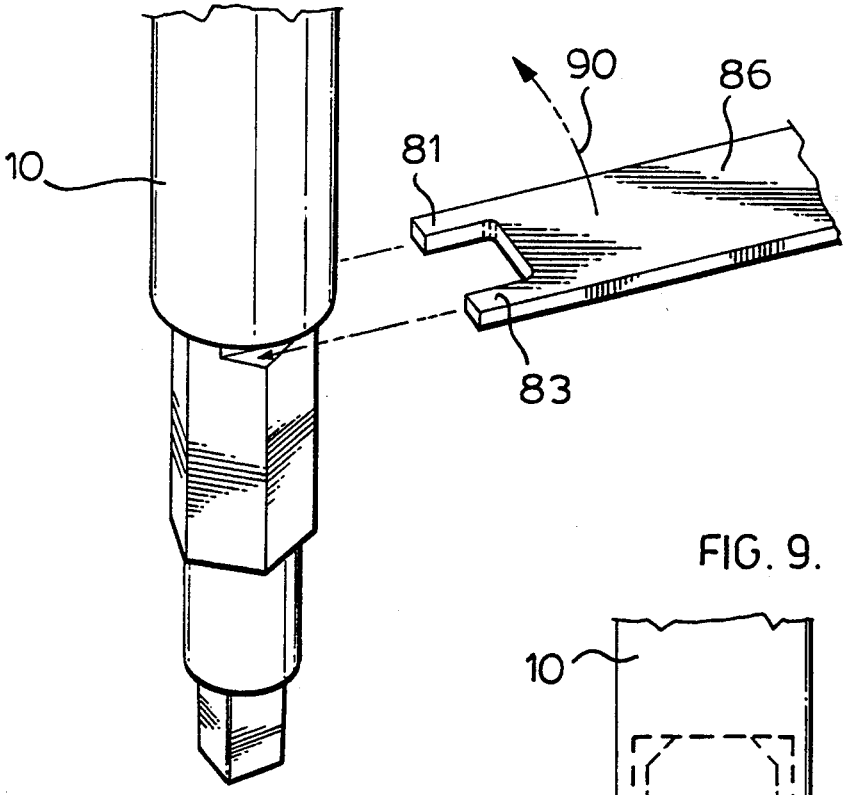
FIG. 8 is a pictorial view of a third embodiment of the present invention showing a mandrel carrying a bit and a lever tool to assist in removal of the bit.
Figure 9:
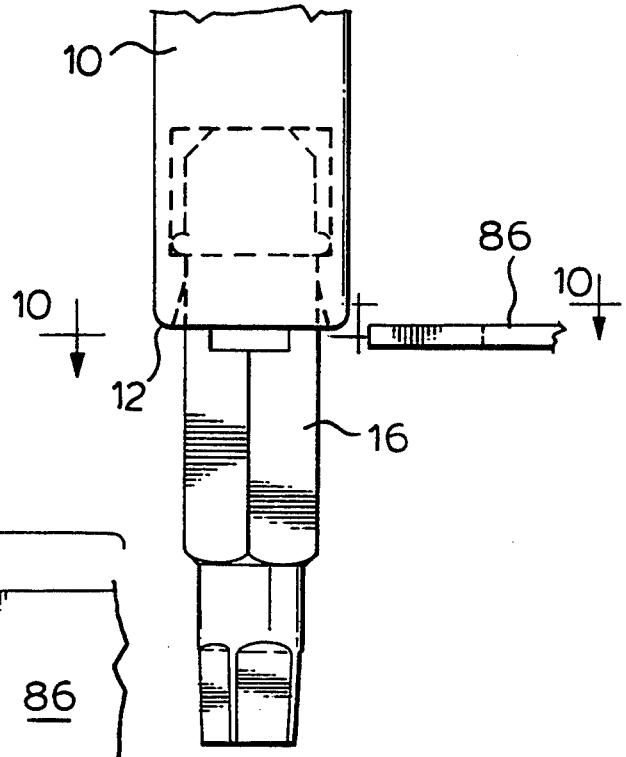
FIG. 9 shows a side view of the assembly of FIG. 8.
Figure 10:
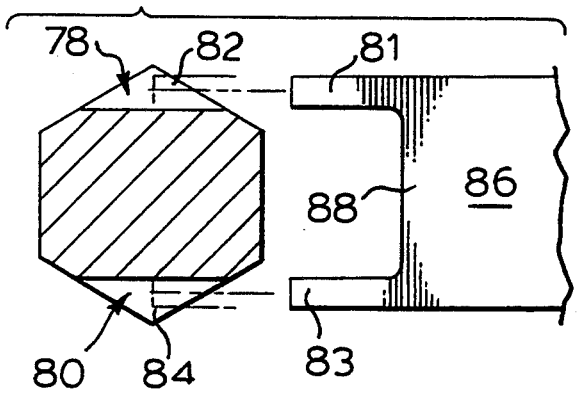
FIG. 10 shows a cross-sectional elevation view of the assembly of FIG. 9 along lines 10—10'.

FIGS. 8, 9 and 10 show a third embodiment of the present invention which is identical to the second embodiment of FIGS. 6 and 7 however utilizes a system for removal of the bit with the lever tool which is different than the slot 58 in the second embodiment. In FIGS. 8 to 10, a bit 16 is provided with two radially inwardly extending side slots 78 and 80, one on each side of the bit which slots present axially directed engagement shoulder surfaces 82 and 84. A lever tool 86 is shown with two prongs 81 and 83 adapted to simultaneously engage the shoulder surfaces 82 and 84. With the central bight portion 88 of the forked end of the tool engaging the axially directed surfaces of the end 12 of the mandrel 10 and the prongs 81 and 83 engaging the shoulder surfaces 82 and 84, pivoting of the tool in the direction of the arrow 90 will apply axially directed forces to the bit to remove the bit.

FIG. 3 shows a partially cross-sectional view of a driver of U.S. Pat. No. 4,146,671 utilizing a mandrel and bit in accordance with the present invention.

Referring now to FIG. 3, FIG. 3 shows a mandrel 10 carrying a bit 16 in the same manner as disclosed in FIG. 2. The mandrel is constantly rotated by having one of its ends secured to the chuck 92 of a power drill not shown. A body 94 is also fixed to the power tool and carries a slide 96, shown in cross-section in FIG. 3 which is reciprocally slidable in a direction along the axis of the mandrel 10. The slide has a guideway 42 within which the mandrel and bit are in effect axially slidable. The guideway in fact extends at least in part about the mandrel 10, bit 16 and a screw 26 to be driven into a workplace 46. In known manner, screws 26 to be driven are carried on a plastic strip 99 and a screw advancing mechanism including a pawl 98 is provided to advance the strip and each of the screws successively into axially alignment within the guideway 42 to become engaged by the bit 16 on the bit and mandrel being moved in relative reciprocal sliding motion within the guideway 42. In a preferred embodiment, the guideway 42 serves to axially guide and locate each of the mandrel 10 and a screw to be driven by engagement of surfaces of the mandrel and by engagement of the head of the screw.

The present invention has been described with reference to use in a power screwdriver for driving correlated strips of screws. The invention is not so limited and may be applied to any screwdriver where a replaceable or disposable bit is desired.

The socket 14 has been preferably disclosed as hexagonally shaped in cross-section. It is to be appreciated that other socket shapes may be useful including other polygonal shapes or other shapes which may be part polygonal only. Of course, a complimentary bit would be used such that the bit will rotate with the socket.

The invention has been described with as a preferred vehicle to secure the bit into the socket, a resilient metal split-ring. Other types of resilient coupling systems may be used. For example, an elastic O-ring of plastic or nylon be stretched so as to initially be received in the groove 28 in the bit 16 and be radially inwardly deformable about its circumference so as to permit insertion of the bit into a socket.

Replacement of the resilient coupling system with each bit permits use of coupling vehicles which only need to be able to be introduced into the socket and removed therefrom once. As such, a resilient coupling such as one of relatively rigid plastic which may be broken on withdrawal as under the substantial forces required to move the bit could be useful. Other resilient couplings could be used preferably carried by the bit for removal and replacement with each replacement of the bit.

Although the invention has been described with reference to preferred embodiments, it is not so limited. Many variations and modifications will now occur to persons skilled in the art. For a definition of the invention, reference is made to the appended claims.

What we claim is:

1. A driver to drive a screw having a selected maximum diameter, the driver comprising:

rotatable screwdriver means comprising:

elongate mandrel means having in one end thereof axially extending socket means with replaceable, screw engaging bit means axially slidably removably received in the socket means for rotation with the socket means;

guideway means to guide a screw coaxially therein, the guideway means having a diameter equal to or marginally greater than the maximum diameter of the screw to assist in coaxially locating and guiding the screw therein, the mandrel means and bit means reciprocally axially movable in the guideway means for engaging and driving a screw through the guideway means into a workpiece;

resiliently deformable means removably retaining the bit means in the socket means;

the resiliently deformable means carried by and removable with the bit means.

2. A driver as claimed in claim 1 wherein the maximum diameter is less than $\frac{1}{2}$ inch.

3. A driver as claimed in claim 1 wherein the maximum diameter is less than $\frac{1}{3}$ inch.

4. A driver as claimed in claim 1 wherein the maximum diameter is less than $\frac{1}{4}$ inch.

5. A driver as claimed in claim 1 wherein said resilient deformable means retains the bit means in the socket means against removable under axially directed forces less than a required force.

6. A driver as claimed in claim 5 wherein said resiliently deformable means comprises:

ring means;

the socket means including a first annular groove therein;

the bit means including a second annular groove thereabout;

the ring means received about the bit means within the second annular groove against removal from the bit means;

the ring means compressible to be received substantially within the second annular grove for movement of the bit means into and out of the socket means;

the ring means biased to expand outwardly from the second annular groove to removably secure the bit means in the socket means by the ring means being disposed partially in the first groove and partially in the second groove.

7. A driver as claimed in claim 6 wherein said ring means comprises:

split-ring means having a first and a second end;

the split-ring means being compressible to move the ends together and thereby reduce the diameter of the split-ring means.

8. A driver as claimed in claim 7 wherein the maximum diameter is less than ½ inch.

9. A driver as claimed in claim 7 wherein the maximum diameter is less than ⅓ inch.

10. A driver as claimed in claim 7 wherein the maximum diameter is less than ¼ inch.

11. A driver as claimed in claim 6 wherein said socket means has a polygonal shape in cross-section, the bit means has a corresponding polygonal shape in cross-section.

12. A driver as claimed in claim 11 wherein said bit means and socket means both comprise metal.

13. A driver as claimed in claim 1 wherein the guideway means locates and guides the screws in axial alignment with the screwdriver means.

14. A driver as claimed in claim 13 wherein the guideway means locates and guides the screwdriver means coaxially therein.

15. A driver as claimed in claim 14 further including means to feed successive screws to place successive screws in axial alignment with the screwdriver means.

16. A driver as claimed in claim 1 wherein the screw has an enlarged head of said maximum diameter; the guideway means extending circumferentially about the screw a sufficient extent to guide and axially locate the head of the screw therein.

17. A driver as claimed in claim 1 further including:

axially directed bit engagement surfaces on the bit means;

axially directed socket engagement surfaces on the mandrel means juxtapositioned relatively to the bit engagement means when the bit means is received in the socket means to be directly axially opposed to the bit engagement surfaces;

separate bit removing lever means having two ends with a first end adapted for simultaneous engagement of both the bit engagement surface and socket engagement surfaces whereby manual pivoting of the other, second end of the lever means with the socket engagement surfaces as a fulcrum applies axially directed forces to the bit engagement surfaces to remove the bit means.

18. A driver as claimed in claim 17 including:

slot means extending radially inwardly into the mandrel means from an opening on one side of the mandrel means into the socket means with, when the bit means is received in the socket means, the bit engagement surfaces open to the slot means;

socket engagement surfaces provided within the slot means;

the first end of the lever means adapted to be removably received within the slot means.

19. A driver as claimed in claim 18 wherein the slot means is located axially inwardly from the socket means and opens axially into the socket means.

20. A driver as claimed in claim 17 wherein:

the socket engagement surfaces comprise surfaces on one end of the mandrel about an entrance to the socket means;

the bit engagement surfaces are provided on axially directed shoulders on portions of the bit means which extend out of the socket means when the bit means is fully received within the socket means.

21. A driver as claimed in claim 20 wherein said shoulder means comprises:

two shoulders, spaced on opposite sides of the bit means;

the first end of the lever means having two spaced end prongs, adapted to simultaneously contact both shoulders.

22. A driver as claimed in claim 5 wherein said resiliently deformable means comprises:

ring means;

the socket means including axially inwardly directed retension shoulder means therein;

the bit means including an annular groove thereabout;

the ring means received about the bit means within the annular groove against removal from the bit means;

the ring means compressible to be received substantially within the annular grove for movement of the bit means into and out of the socket means;

the ring means biased to expand outwardly from the annular groove to removably secure the bit means in the socket means by the ring means being disposed axially inwardly of and engaging the retension shoulder means.

23. A driver as claimed in claim 22 wherein an annular space separates the bit means radially from the socket means axially inwardly from the socket means.

24. A driver as claimed in claim 23 wherein said socket means has a polygonal shape in cross-section axially outwardly of the retension shoulder means and the bit means has a corresponding polygonal shape in cross-section to engage the socket means for rotation therewith.

25. A driver to drive a screw having a selected maximum diameter, the driver comprising:

rotatable screwdriver means comprising:

elongate mandrel means having in one end thereof axially extending socket means with replaceable, screw engaging bit means axially slidably removably received in the socket means for rotation with the socket means;

guideway means to guide a screw coaxially therein, the guideway means having a diameter equal to or marginally greater than the maximum diameter of the screw to assist in coaxially locating and guiding the screw therein;

the mandrel means and bit means reciprocally axially movable in the guideway means for engaging and driving a screw through the guideway means into a workpiece;

resiliently deformable means removably retaining the bit means in the socket means;

the resiliently deformable means carried by and removable with the bit means;

the socket means having end stop shoulders at an axially innermost end thereof;

the bit means having axially directed innermost end surfaces which engage the end stop shoulders to limit axial sliding of the bit means into the socket means;

slot means extending radially inwardly into the mandrel means from an opening on one side of the mandrel means;

the slot means located axially inwardly from the socket means and opening axially into the socket means through the end stop shoulder such that, when the bit means is received in the socket means, the bit means end surfaces are exposed and open to the slot means;

axially directed socket engagement surfaces provided on the mandrel means within the slot means;

the socket engagement surfaces juxtapositioned relatively to the bit means end surfaces when the bit means is received in the socket means to be directly axially opposed to the bit means end surfaces;

separate bit removing lever means having two ends with a first end adapted for simultaneous engagement of both the bit means end surfaces and socket engagement surfaces whereby manual pivoting of the other, second end of the lever means with the socket engagement surfaces as a fulcrum applies axially directed forces to the bit means end surfaces sufficient to remove the bit means;

the first end of the lever means adapted to be removably received within the slot means.

26. A screwdriver having:

elongate mandrel means having in one end thereof axially extending socket means;

removable, screw engaging bit means axially slidably received in the socket means for rotation with the socket means;

the bit means retained in the socket means against removal under axially directed forces less than a required force;

the socket means having end stop shoulders at an axially innermost end thereof;

the bit means having axially directed innermost end surfaces which engage the end stop shoulders to limit axial sliding of the bit means into the socket means;

slot means extending radially inwardly into the mandrel means from an opening on one side of the mandrel means;

the slot means located axially inwardly from the socket means and opening axially into the socket means through the end stop shoulder such that, when the bit means is received in the socket means, the bit means end surfaces are exposed and open to the slot means;

axially directed socket engagement surfaces provided on the mandrel means within the slot means;

the socket engagement surfaces juxtapositioned relatively to the bit means end surfaces when the bit means is received in the socket means to be directly axially opposed to the bit means end surfaces;

separate bit removing lever means having two ends with a first end adapted for simultaneous engagement of both the bit means end surfaces and socket engagement surfaces whereby manual pivoting of the other, second end of the lever means with the socket engagement surfaces as a fulcrum applies axially directed forces to the bit means end surfaces sufficient to remove the bit means;

the first end of the lever means adapted to be removably received within the slot means.

* * * * *